US006681449B2

(12) United States Patent
Többen

(10) Patent No.: US 6,681,449 B2
(45) Date of Patent: Jan. 27, 2004

(54) ROLLER CLEANING DEVICE HAVING VARIABLE SUCTION

(75) Inventor: Robert Többen, Monchengladbach (DE)

(73) Assignee: Trützschler GmbH & Co. KG., Mönchengladbach (DE)

( * ) Notice: Subject to any disclaimer, the term of this patent is extended or adjusted under 35 U.S.C. 154(b) by 0 days.

(21) Appl. No.: 10/234,332

(22) Filed: Sep. 5, 2002

(65) Prior Publication Data

US 2003/0041414 A1 Mar. 6, 2003

(30) Foreign Application Priority Data

Sep. 6, 2001 (DE) ..... 101 43 671

(51) Int. Cl.[7] ..... D01G 15/00
(52) U.S. Cl. ..... 19/98; 19/107
(58) Field of Search ..... 19/98, 105, 106 R, 19/107, 108, 109, 200, 202, 203, 204, 205, 218, 65 R

(56) References Cited

U.S. PATENT DOCUMENTS

| | | | | | |
|---|---|---|---|---|---|
| 2,284,750 | A | * | 6/1942 | Landreth | 19/107 |
| 3,376,610 | A | * | 4/1968 | Williams | 19/107 |
| 3,387,335 | A | * | 6/1968 | Landers et al. | 19/107 |
| 3,604,061 | A | * | 9/1971 | King, Jr. | 19/107 |
| 3,614,813 | A | * | 10/1971 | Sloan | 19/107 |
| 3,648,329 | A | * | 3/1972 | King, Jr. | 19/107 |
| 3,678,538 | A | * | 7/1972 | Sloan | 19/107 |
| 3,849,837 | A | * | 11/1974 | Bass, Jr. et al. | 19/107 |
| 4,074,391 | A | * | 2/1978 | Jenkins, Jr. et al. | 19/107 |
| 4,079,483 | A | * | 3/1978 | Hicks | 19/107 |
| 4,227,285 | A | * | 10/1980 | Hamrick | 19/107 |
| 4,527,307 | A | * | 7/1985 | Teichmann | 19/107 |
| 4,811,464 | A | * | 3/1989 | Giuliani | 19/107 |
| 4,964,196 | A | * | 10/1990 | Schmid et al. | 19/200 |
| 4,985,966 | A | * | 1/1991 | Nitschke et al. | 19/107 |
| 5,247,722 | A | * | 9/1993 | Leifeld | 19/105 |
| 5,720,075 | A | * | 2/1998 | Rudolf | 15/301 |

FOREIGN PATENT DOCUMENTS

| | | |
|---|---|---|
| CH | 2 83 012 A | 9/1952 |
| DE | 2 32 644 A | 3/1911 |
| DE | P.A. 196287 | 4/1957 |
| DE | 39 02 202 A1 | 8/1990 |
| DE | 195 22 154 A1 | 1/1997 |
| EP | 0 750 059 A1 | 12/1996 |
| GB | 889214 | 2/1962 |
| GB | 1 515 055 | 6/1978 |
| GB | 1 551 068 | 8/1979 |
| GB | 2 228 495 A | 8/1990 |
| GB | 2 357 780 A | 7/2001 |
| JP | 58 8129 | 1/1983 |

* cited by examiner

*Primary Examiner*—Gary L. Welsh
(74) *Attorney, Agent, or Firm*—Venable, LLP; Robert Kinberg

(57) ABSTRACT

A vacuum device is provided for use with a textile processing machine having a rotating roller with cleaning locations. The device has a vacuum generator, a main vacuum line operatively associated with the vacuum generator, a plurality of individual vacuum lines, and a vacuum control valve. Each of the individual vacuum lines has at least one cleaning opening. Each of the cleaning openings is for positioning at one of the cleaning locations. The vacuum generator creates a first vacuum at the upstream side of the vacuum control valve when the vacuum control valve is in one operating position, and a second vacuum at the upstream side of the vacuum control valve when the vacuum control valve is in a secondary operating position. The second vacuum is stronger than the first vacuum.

13 Claims, 3 Drawing Sheets

ROLLER CLEANING DEVICE HAVING VARIABLE SUCTION

CROSS-REFERENCE TO RELATED APPLICATION

This application claims priority to German Patent Application No. 101 43 671.8 filed on Sep. 6, 2001, the disclosure of which is incorporated herein by reference.

BACKGROUND OF THE INVENTION

The invention relates to a device for use with a carding, cleaning, or similar machine for textile material such as cotton, synthetic fibers or the like. The device is provided with, for example, at least one rotating sawtooth roller or pin roller to which a vacuum can be applied at cleaning locations on the roller. The low-pressure vacuum generated by a vacuum system is supplied, for example, by a main line and individual branch lines to the cleaning locations. In some machines, at least one of the suction lines on a main carding cylinder is under vacuum constantly.

In the device show in European Patent 0 750 059, waste material in the licker-in region is not removed continuously, but drops into a collection box arranged below the licker-in. This waste is then removed from the collection box periodically. As a result, no continuous vacuum is required in the region of the licker-in. The intermittent emptying of the collection box results in the suctioning effect in the region of the licker-in being limited to an extremely short time interval and does not significantly influence the loss of desirable fibers. In contrast, a continuous suctioning takes place at suctioning locations on the carding cylinder. For a carding machine where the low pressure generated by a central vacuum system is applied via a joint line to the cleaning locations, an intermittent actuation of a valve is used to empty the waste material collected in the collection box via a transfer line that connects the collection line to the collection box as well as the joint line. During the emptying of the collection box, the valve maintains a reduced low pressure at the cleaning locations. In the process, the pressure is reduced only briefly by the same amount at all cleaning locations on the main carding cylinder. In contrast, the cleaning locations are fully suctioned nearly all of the time. The high total amount of air required for removing the waste material is a disadvantage. Further, an increase in the number of cleaning locations, based on an increase in the requirements for production and quality, magnifies this problem. The amount of air required for removing the waste material consequently rises, leading to a high expenditure of energy and higher operating costs.

SUMMARY OF THE INVENTION

It is an object of the invention to create a device which avoids the aforementioned disadvantages and, in particular, reduces the total amount of air required for removing the waste material, especially for an increasing number of cleaning locations.

Particular embodiments of the invention provide a vacuum device for use with a textile processing machine having a rotating roller with cleaning locations. The device has a vacuum generator, a main vacuum line operatively associated with the vacuum generator, a plurality of individual vacuum lines, and a vacuum control valve having an upstream side and a downstream side, the upstream side being opposite the vacuum generator. Each of the individual vacuum lines is operatively associated with the main vacuum line and has at least one cleaning opening. Each of the cleaning openings is for positioning at one of the cleaning locations. The vacuum generator creates a first vacuum at the upstream side of the vacuum control valve when the vacuum control valve is in one operating position, and a second vacuum at the upstream side of the vacuum control valve when the vacuum control valve is in a second operating position. The second vacuum is stronger than the first vacuum.

Other embodiments of the invention provide a textile processing machine. The machine has a rotating roller with cleaning locations, and a vacuum device. The vacuum device has a vacuum generator, a main vacuum line operatively associated with the vacuum generator, a plurality of individual vacuum lines, and a vacuum control valve having an upstream side and a downstream side, the upstream side being opposite the vacuum generator. Each of the individual vacuum lines is operatively associated with the main vacuum line and has at least one cleaning opening. Each of the cleaning openings is positioned at one of the cleaning locations. The vacuum generator creates a first vacuum at the upstream side of the vacuum control valve when the vacuum control valve is in one operating position, and a second vacuum at the upstream side of the vacuum control valve when the vacuum control valve is in a second operating position. The second vacuum is stronger than the first vacuum.

The invention can reduce the total amount of air required for waste removal. Sufficient cleaning can be achieved if at least some of the cleaning locations on the main carding cylinder are not provided with constant full-strength vacuum. It is sufficient to use a relatively weak airflow (partial vacuum) for suctioning off undesirable dust, at least at certain cleaning locations. Using a partial vacuum at these cleaning locations permits the use of a full-strength vacuum during brief intervals to remove the collected waste material while providing an overall reduction in the amount of air required. The higher the number of cleaning locations, the stronger the effect of the partial vacuum, which further reduces the air and energy expenditure.

The vacuum control valve can switch between partial vacuum and full vacuum. The cleaning locations suction and store waste with a low vacuum during a particular time period. The stored waste material is suctioned out with a higher amount of air, but only during brief time intervals. The vacuum lines are preferably combined, at least in part, to form groups. The vacuum control valve is preferably provided with an arrangement of slide valves.

BRIEF DESCRIPTION OF THE DRAWINGS

The invention is explained below in further detail with the aid of exemplary embodiments shown in the drawings, wherein.

DETAILED DESCRIPTION OF PREFERRED EMBODIMENTS

Figure 1:
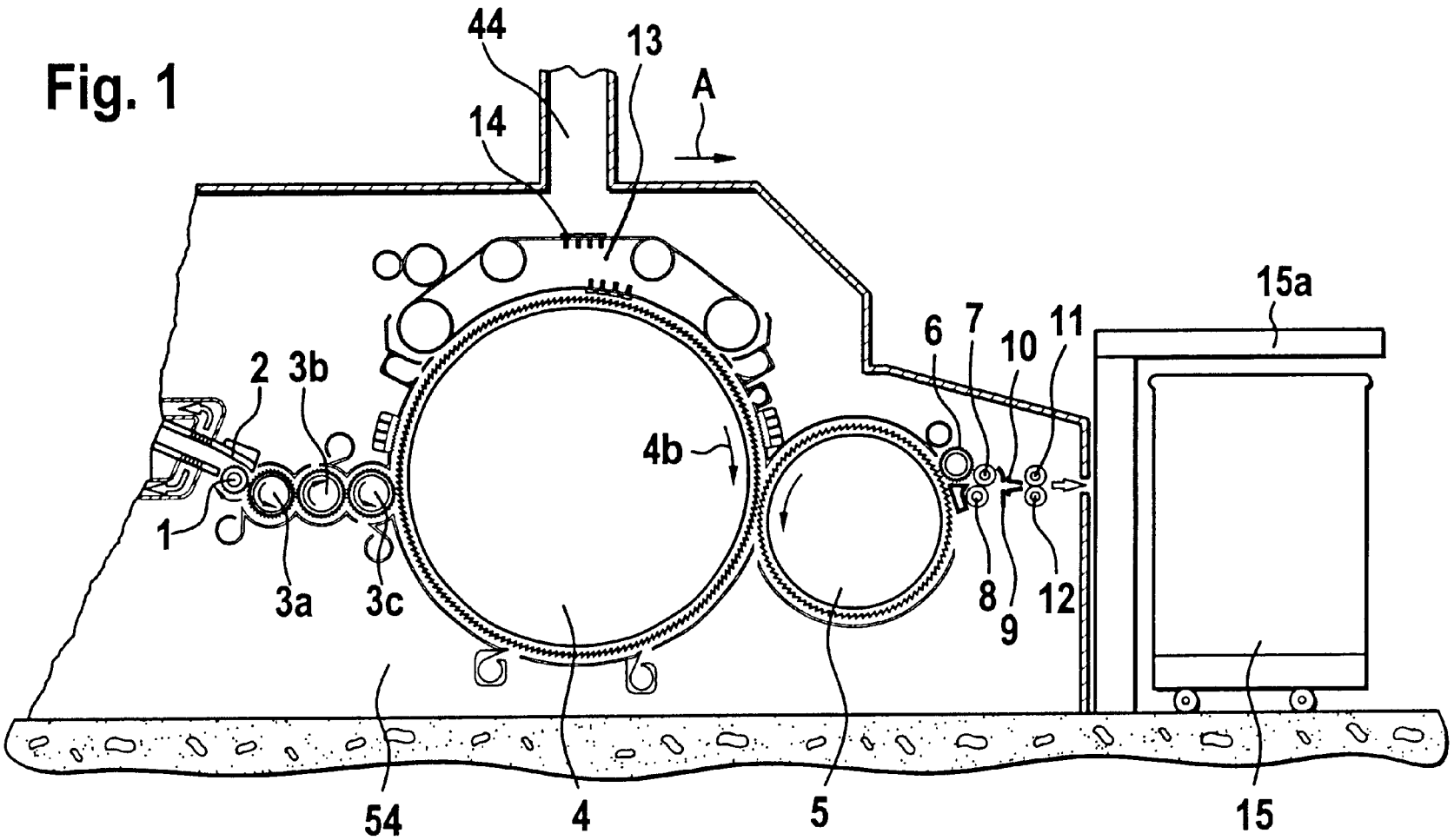
FIG. 1 is a schematic side elevation view of a carding machine having a central suctioning channel.

FIG. 1 shows a carding machine, for example a high-performance carding machine Model DK 903 manufactured by the company Trützschler in Mönchengladbach, Germany. This carding machine is provided with feed roller 1, feed table 2, licker-ins 3*a*, 3*b*, 3*c*, main carding cylinder 4 having rotational direction 4*b*, doffer 5, stripping roller 6, crushing rollers 7, 8, sliver guide element 9, web trumpet 10, withdrawing rollers 11, 12, traveling flats 13 with flat bars 14, can 15 and can holder 15*a*. Curved arrows indicate the rotational direction of the rollers while arrow A indicates the operating direction. A central vacuum channel 44 and a chamber 54 below the carding machine are provided.

Figure 2:
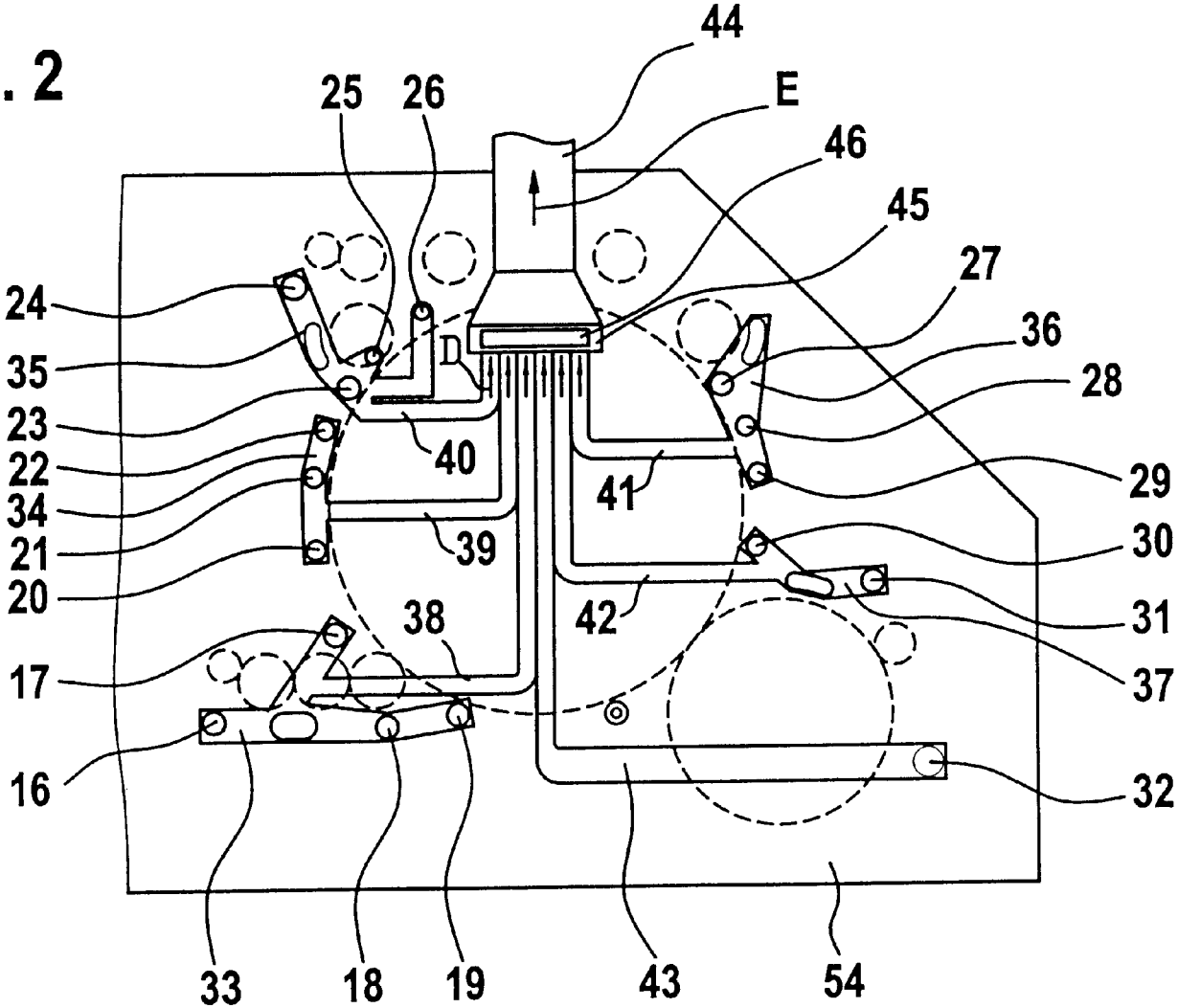
FIG. 2 is a side elevation view of the carding machine shown in FIG. 1.

The carding machine according to FIG. 2 is provided with a plurality of cleaning locations 16 to 32 for dust, trash or the like. An example of such a cleaning location is the suctioning hood 52 shown in FIG. 4. A suction box 33 incorporates cleaning locations 16 to 19, a suction box 34 incorporates cleaning locations 20 to 22, a suction box 35 incorporates cleaning locations 23 to 26, a suction box 36 incorporates cleaning locations 27 to 29, and a suction box 37 incorporates cleaning locations 30 and 31. The suction box 33 is connected via a vacuum line 38 to an intake of a collection device 45. Similarly, suction boxes 34–37 are connected via vacuum lines 39–42, respectively, to the intake of the collection device 45. Vacuum line 43 is an example of a vacuum line that is connected to an individual cleaning location 32. The central vacuum channel 44 is connected to a suction air source (not shown herein) and is connected to an output of the collection device 45. A vacuum control valve 46 for switching between a partial-strength and a full-strength vacuum is positioned, in this example, inside the collection device 45. Vacuum control valve 46 controls the vacuum level at cleaning locations 16 to 32, the suction boxes 33 to 37, and the vacuum lines 38 to 43.

Figure 3:
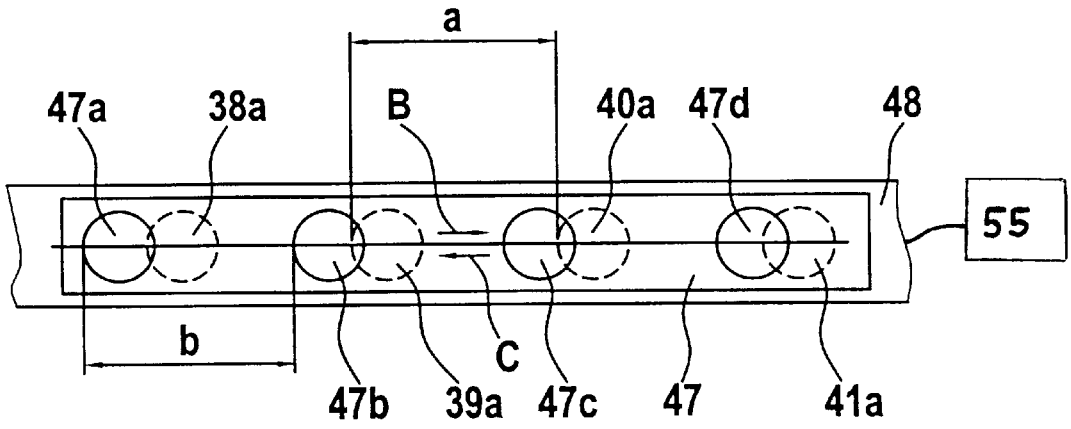
FIG. 3 shows a slide element with partially opened air flow openings.

To switch between a partial-strength and a full-strength vacuum, the vacuum control valve 46 has a valve arrangement with a series of adjustable valve openings. As shown in FIG. 3, the valve openings can be adjustable throttle slide valves. The slide valve element 47 (for example, a sheet metal slider) can be moved back and forth in the direction of arrows B and C. The slide valve element 47 is provided, in this example, with four circular air flow openings 47*a* to 47*d*. However, different opening shapes, such as elliptical or square, can be used as well. The air flow openings 47*a* to 47*d* are created through stamping, nibbling, laser cutting, or the like. Openings 38*a* to 41*a* are provided in joint holding element 48, to which the ends of the vacuum lines 38 to 43 are fastened. In this example, only four openings 38*a* to 41*a* are shown, however, more or fewer openings can be provided. For example, one opening can be provided for each vacuum line. The distance a between the openings 38*a* to 41*a* (end regions of the vacuum lines 38 to 43) and the distance b between the air flow openings 47*a* to 47*d* can be the same. In other embodiments, distances a and b can vary for different openings to create different vacuum levels for different vacuum lines at different locations of the slide valve element 47.

As shown in FIG. 3, the slide valve element 47 is in a position where the openings 38*a* to 41*a* and the air flow-through openings 47*a* to 47*d* are only partially positioned one above the other. As a result, the flow E (FIG. 2) of air can flow from the collection device 45 into the central vacuum channel 44. The openings 38*a* to 41*a* open up respectively different areas due to different distances between the air-flow openings 47*a* to 47*d* relative to each other and relative to the openings 38*a* to 41*a*. The air-flow openings 47*a* to 47*d* on the slide valve element 47 are easy to produce and install. The advantage of having different size opening areas is that a different amount of air can flow out through the vacuum lines 38 to 43 in the form of airflow D (FIG. 2). A drive (not shown herein), e.g. a stepping motor, is used to displace the slide valve element 47 in the direction of arrows B and C. The drive can be connected to an electrical or mechanical control device 55 to regulate the vacuum control valve 46.

Figure 4:
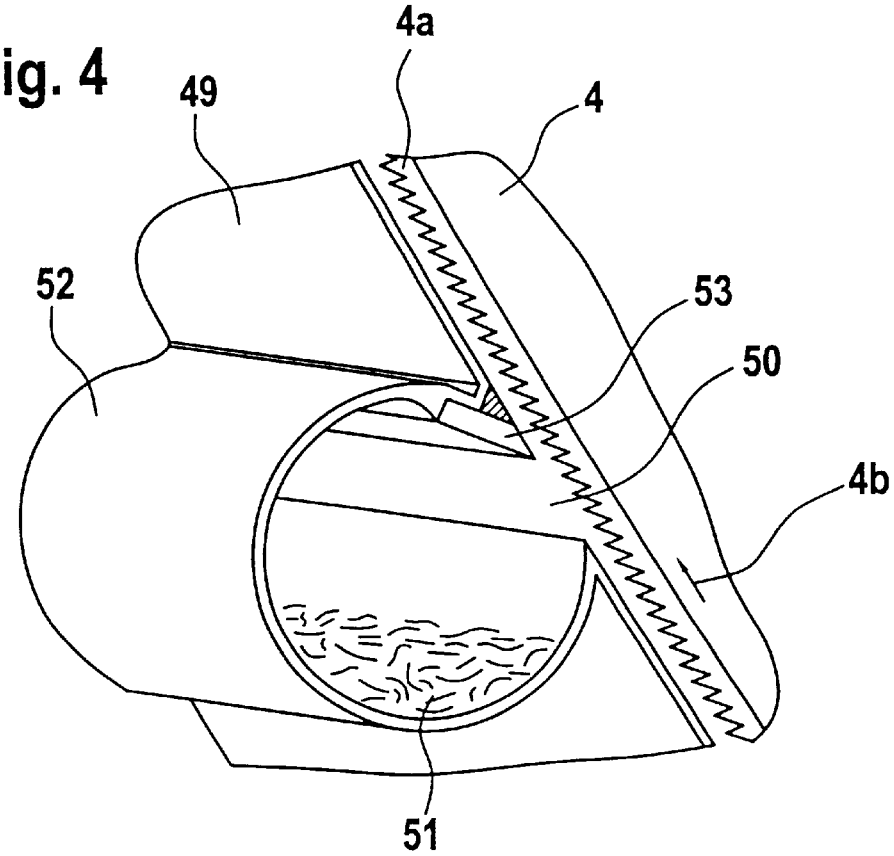
FIG. 4 is a perspective view which shows a suctioning hood.

As shown in FIG. 4, a cover 49 of the main carding cylinder 4 is provided with an opening 50 opposite cylinder clothing 4*a*. Dust, trash particles 51, and the like enter the suctioning hood 52 through opening 50. A weak airflow is produced by providing a partial vacuum to suctioning hood 52 so that heavy trash particles 51, collect in a lower region of suctioning hood 52 while dust is suctioned out continuously. From time to time, e.g., following a predetermined time period, the suctioning hood 52 is briefly subjected to a stronger or full-strength vacuum so that waste material 51 is suctioned out and removed. A separation knife 53 can be provided to facilitate the separation of waste material 51 from the desirable material on main carding cylinder 4.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A vacuum device for use with a textile processing machine having a rotating roller with cleaning locations, the device comprising:

a vacuum generator;

a main vacuum line operatively associated with the vacuum generator;

a plurality of individual vacuum lines, each of the individual vacuum lines being operatively associated with the main vacuum line and having at least one cleaning opening; and a vacuum control valve operatively positioned between the main vacuum line and the plurality of individual vacuum lines and having an upstream side and a downstream side, the upstream side being opposite the vacuum generator, wherein each of the cleaning openings is for positioning at one of the cleaning locations, the vacuum generator creates a first vacuum at the upstream side of the vacuum control valve when the vacuum control valve is in one operating position, the vacuum generator creates a second vacuum at the upstream side of the vacuum control valve when the vacuum control valve is in a second operating position, and the second vacuum is stronger than the first vacuum.

2. The device of claim 1, wherein the vacuum generator generates the first vacuum at substantially all times when the textile processing machine is in operation.

3. The device of claim 1, wherein the first vacuum is sufficient to pull waste material into the cleaning openings and is insufficient to pull the waste material through the vacuum control valve.

4. The device of 3, wherein the second vacuum is sufficient to pull the waste material through the vacuum control valve.

5. The device of claim 1, wherein particular ones of the plurality of individual vacuum lines form groups.

6. The device of claim 1, wherein the vacuum control valve further comprises a plurality of valve openings.

7. The device of claim 6, wherein the control valve comprises a system of slide valves.

8. The device of claim 1, wherein the rotating roller is a main carding cylinder, and at least one of the cleaning locations is adjacent the main carding cylinder.

9. The device of claim 1, wherein the machine has a licker-in and at least one of the cleaning locations is adjacent the licker-in.

10. The device of claim 1, wherein the machine has a doffer and at least one of the cleaning locations is adjacent the doffer.

11. The device of claim 1, wherein the rotating roller is a main carding cylinder and the machine has a chamber below the main carding cylinder, and at least one of the cleaning locations is located in the chamber below the main carding cylinder.

12. The device of claim 1, further comprising an electronic valve control and regulating device, wherein the valve openings are controlled by the electronic valve control and regulating device.

13. A textile processing machine, comprising:

a rotating roller with cleaning locations; and a vacuum device including a vacuum generator;

a main vacuum line operatively associated with the vacuum generator;

a plurality of individual vacuum lines, each of the individual vacuum lines being operatively associated with the main vacuum line and having at least one cleaning opening; and a vacuum control valve operatively positioned between the main vacuum line and the plurality of individual vacuum lines and having an upstream side and a downstream side, the upstream side being opposite the vacuum generator, wherein each of the cleaning openings is positioned at one of the cleaning locations, the vacuum generator creates a first vacuum at the upstream side of the vacuum control valve when the vacuum control valve is in one operating position, the vacuum generator creates a second vacuum at the upstream side of the vacuum control valve when the vacuum control valve is in a second operating position, and the second vacuum is stronger than the first vacuum.

* * * * *